US006829802B2

(12) United States Patent
McKenzie

(10) Patent No.: US 6,829,802 B2
(45) Date of Patent: Dec. 14, 2004

(54) FITTED DUSTING-CLEANING GLOVE WITH BUILT-IN CREVICE CLEANING TUFT

(75) Inventor: Rebecca Anne McKenzie, 1308 Road 129, Cabin #4, Glenwood Springs, CO (US) 81601

(73) Assignee: Rebecca Anne McKenzie, Glenwood Springs, CO (US)

( * ) Notice: Subject to any disclaimer, the term of this patent is extended or adjusted under 35 U.S.C. 154(b) by 89 days.

(21) Appl. No.: 10/126,817

(22) Filed: Apr. 20, 2002

(65) Prior Publication Data

US 2003/0196290 A1 Oct. 23, 2003

(51) Int. Cl.[7] ..... A47L 1/06; A47L 25/00
(52) U.S. Cl. ..... 15/227; 2/159; 15/210.1
(58) Field of Search ..... 15/227, 209.1, 15/210.1; 2/159, 163; D32/40, 42

(56) References Cited

U.S. PATENT DOCUMENTS 1,254,913 A * 1/1918 Kitamura ..... 15/227
1,469,029 A * 9/1923 Underwood et al. ..... 15/227
1,478,914 A * 12/1923 Ritzenthaler ..... 15/227
1,564,219 A * 12/1925 Drueding ..... 15/227
3,675,264 A * 7/1972 Storandt ..... 15/104.94
3,902,509 A * 9/1975 Tundermann et al. ..... 433/142
4,038,787 A 8/1977 Bianchi
4,104,740 A 8/1978 Rinehart
4,621,388 A 11/1986 Ortolivo
4,980,943 A 1/1991 Barber
5,127,127 A * 7/1992 Jarosinski ..... 15/227
D365,896 S * 1/1996 Zuege ..... D32/40
5,673,435 A 10/1997 Gebhard
5,815,840 A 10/1998 Hamlin
5,979,007 A * 11/1999 Soon ..... 15/227
6,000,060 A 12/1999 Borucki-Mastej
6,018,837 A 2/2000 Andreu

OTHER PUBLICATIONS

Griot's Garage,Products for your garage, Garage Handbook No. 145 3500–A 20th St.E. Tahoma, WA098424.

* cited by examiner

*Primary Examiner*—Robert J. Warden, Sr.
*Assistant Examiner*—Laura C Cole

(57) ABSTRACT

A multi-task, ambidexterous, fitted dusting-cleaning glove featuring intentional, protrusive exterior side seams 12, palm seams 14, and finger seams 16 terminating in tufts 20 extending beyond the fingertips; each tuft functioning as an instant crevice tool. The exterior seam and tuft application creates added mass in the item's dimension. The said glove, comprising four fingers and one thumb, sized for a close fit in the finger portions is an articulate cleaning tool.

7 Claims, 4 Drawing Sheets

FITTED DUSTING-CLEANING GLOVE WITH BUILT-IN CREVICE CLEANING TUFT

BACKGROUND

1. Field of Invention

This invention relates to cleaning tools, specifically to an improved dusting-cleaning glove featuring a built-in crevice tool.

2. Description of Prior Art

In addition to a plethora of dusting and cleaning cloths on the market, a number of cleaning gloves and mitts have also been developed. Most of these feature various gimmicks and contrivances which have been added to the glove or mitt which make them bulky and cumbersome to use. Such as U.S. Pat. No. 4,104,740 to Rinehart (1978) which discloses a glove construction within a mitten form. Or U.S. Pat. No. 4,980,943 to Barber (1991) which features a fringe of yarns on the sides of a glove configuration. And some depend primarily on a special base fabric such as U.S. Pat. No. 6,000,060 to Borucki-Mastej (1999). Most of these cleaning devices are limited to one or two specific cleaning applications at most. Most professionals still prefer a cleaning cloth over awkward, ill-fitted mitts or gloves with limited useage, because the cloth is more adaptable in most cleaning situations.

When cleaning or dusting, one is continually presented with the issue of reaching under, over and around various objects and into crevices. One would typically (especially a professional cleaning person) fold a cleaning cloth to create a stiffness and a crease to reach into, under and around such areas. This procedure works well enough, but valuable time is lost in the arrayal of the cloth.

When dusting or cleaning, one is continually challenged with cluttered and constrictive areas. One typically attemps to conform a cleaning cloth to wrap around the hand in order to avoid upsetting or breaking objects. Due to the thickness of the wrapped cloth, it's an awkward solution at best.

Additionally, when dusting or cleaning, one is often presented with a sundry of nooks and crannies, and varied shapes. A cleaning cloth, mitt or loose fitting glove can only make contact with the surface points that the hand can hold it to; necessitating the addition of other tools such as cotton swabs etc. to complete the task satisfactorily.

OBJECTS AND ADVANTAGES

Accordingly, several objects and advantages of my invention are:

(a) that the seam and tuft features embodied in my dusting-cleaning glove transform it into a completely self-contained dusting, cleaning and crevice tool that saves time and increases cleaning effectiveness.

(b) that unlike other gloves or mitts now in use, my invention is streamlined in design and so fitted as to become an integral part of the wearer's hand when in use. All aspects of one's hand are used when in a back-swipe motion.

(c) that the primary effectiveness of my invention relies on the design and construction features complemented by a fabric base that is appropriate for the glove's intended use.

For example, when cleaning under, over and around various objects, the seam and tuft construction of my dusting-cleaning glove creates an already formed crevice device which quickly and automatically reaches into, under, and around any such cleaning matter. Thus, eliminating the hassle of creasing or arranging cleaning cloths to fit the task.

Another primary feature of my invention is a close, snug fit of the finger portions of the glove that automatically assures a precise, and accurate awareness of all points of contact. Because the cleaning cloth matter is securely fitted to a user's fingers, the muscles of the hand need only to maneuver the fingers and the tufts to the points of contact. This is a distinct advantage when cleaning cluttered or constrictive areas; or when cleaning oddly or intricately shaped objects. Thus eliminating the inconvenience of wrapping a cleaning cloth around the hand; or to risk the hazzards of trying to grasp a cleaning cloth wrapped around one hand while simultaneously attempting to move objects out of the way with the other hand.

A close, secure fit also allows the wearer to leave my dusting-cleaning glove in place while switching cleaning tasks or while using other tools. The wearer saves time and motion by avoiding the act of removing the glove before picking up a new tool.

When working with large, broad cleaning areas, one may choose to wear my dusting-cleaning glove on both hands for optimum use of time and motion. Both hands are also useful when cleaning or polishing a single, small object. The close fit of the finger portions of my dusting-cleaning glove provides a secure grip and surface awareness of the object to be cleaned.

While a cleaning cloth or mitt can only contact the surface points that the hand can hold it to; my fitted dusting-cleaning glove allows for all sides of the fingers, thumb and hand to make direct, specific contact with varied shapes in a variety of hand positions. While one may fold or wad a cleaning cloth to a somewhat compact configuration, my seam and tuft design is trimly constructed for exceptional maneuverability and manipulation of the glove.

When cleaning, one is presented with a cleaning "area". With a seam and tuft application, more fabric mass is concentrated into a smaller dimension, thus more fabric matter is focused on the cleaning "area".

Because the aforementioned exterior seam and tuft design's effectiveness is enhanced by a secure, close fit, my dusting-cleaning glove will be offered in sizes X-small, small, med., large and X-large with the primary fit residing in the finger portions of the glove. The fit in the finger portions of the glove tend to create a tension between the pinky and the thumb when the glove is in use. This tension contributes an added insurance that the glove will not slip on the hand when properly fitted.

The unique design and exceptional performance of my dusting-cleaning device is clearly unparalleled in the cleaning profession at this time.

Further objects and advantages of my invention will become apparent from a consideration of the drawings and ensuing description.

DRAWING FIGURES

In the drawings, closely related figures have the same number but different alphabetic suffixes.

FIGS. 1A to 1C show various aspects of a dusting-cleaning glove as constructed with intentional, exterior body side-seams, finger side-seams and a plurality of palm seams with the finger seams terminating in a created tuft at each fingertip.

FIGS. 2A to 2C show a similar-glove with body side-seams and finger side-seams only with the finger seams terminating in a created tuft at each fingertip.

FIG. 8 shows how two gloves can work simultaneously while polishing, cleaning or dusting.

REFERENCE NUMERALS IN DRAWINGS

10 opening for wearer's hand

12 standard exterior body-seam

14 standard exterior palm seam

16 standard exterior finger side-seam

18 seam allowance

20 tuft

22 decorative zigzag stitch as applied to tuft

DESCRIPTION—FIGS. 1 to 3

Figure 1A:
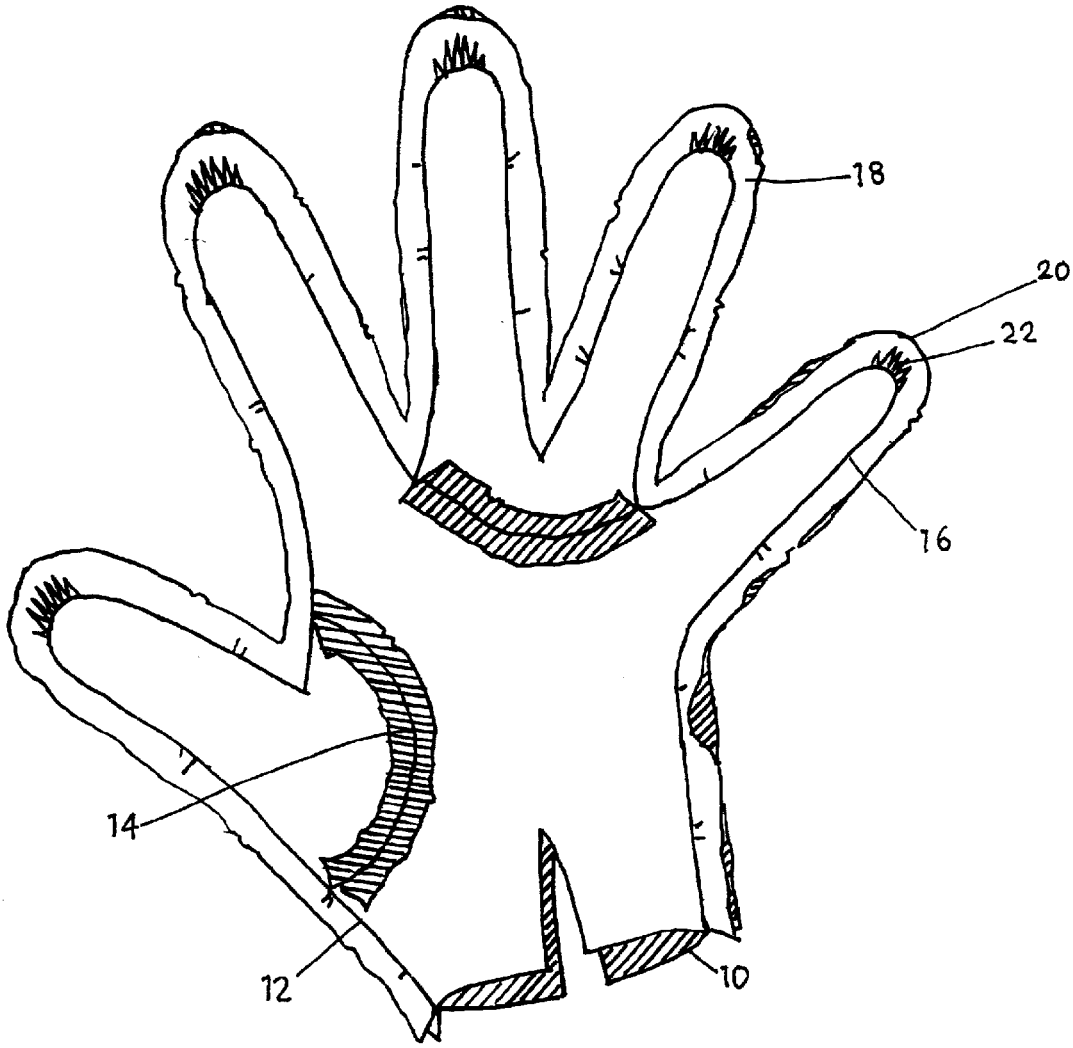
Figure 1B:
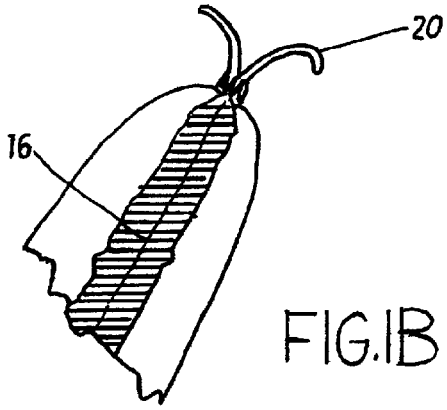

A typical embodiment of my invention is illustrated in FIG. 1A showing a surface of the glove. The basic glove configuration (four fingers and one thumb) entertains intentional, protrusive, and uniformly shallow (See FIGS. 1A, 2A and 3A), exterior (wrong side placed together, and seamed on the right side) body side-seams 12, finger side-seams 16, and a plurality of palm seams 14, all of which plain, standard seams (See FIGS. 1A, 2A and 3A, with the exception of expanded seam allowances occurring on each glove fingertip, which are left raw (unfinished and unpressed). The glove sides, having similarly configured front surface and back surface are joined together at their common sides after the palm seams 14 have been stitched in place. As the finger side-seams 16 extend to the glove fingertips, where an added length of fabric in the form of an expanded seam allowance 18 (a widening of the space between the cutting line and the seam line) naturally produces a conspicuous tuft 20. The expanded seam allowance provides a slightly increased length of fabric at the glove fingertip. It should be understood that my, crevice cleaning tuft 20 consists of a slightly expanded seam allowance anchored to the seam line, and occurring only at each glove fingertip with no added extraneous material. However, the tuft may optionally be secured with a simple decorative zigzag stitch 22 or an equivalent within the seam allowance 18 abutting the seam line to add stability and stiffness when desired. (See FIGS. 1A and 3A). A side view of the tuft 20 is shown In FIG. 1B.

Figure 2A:
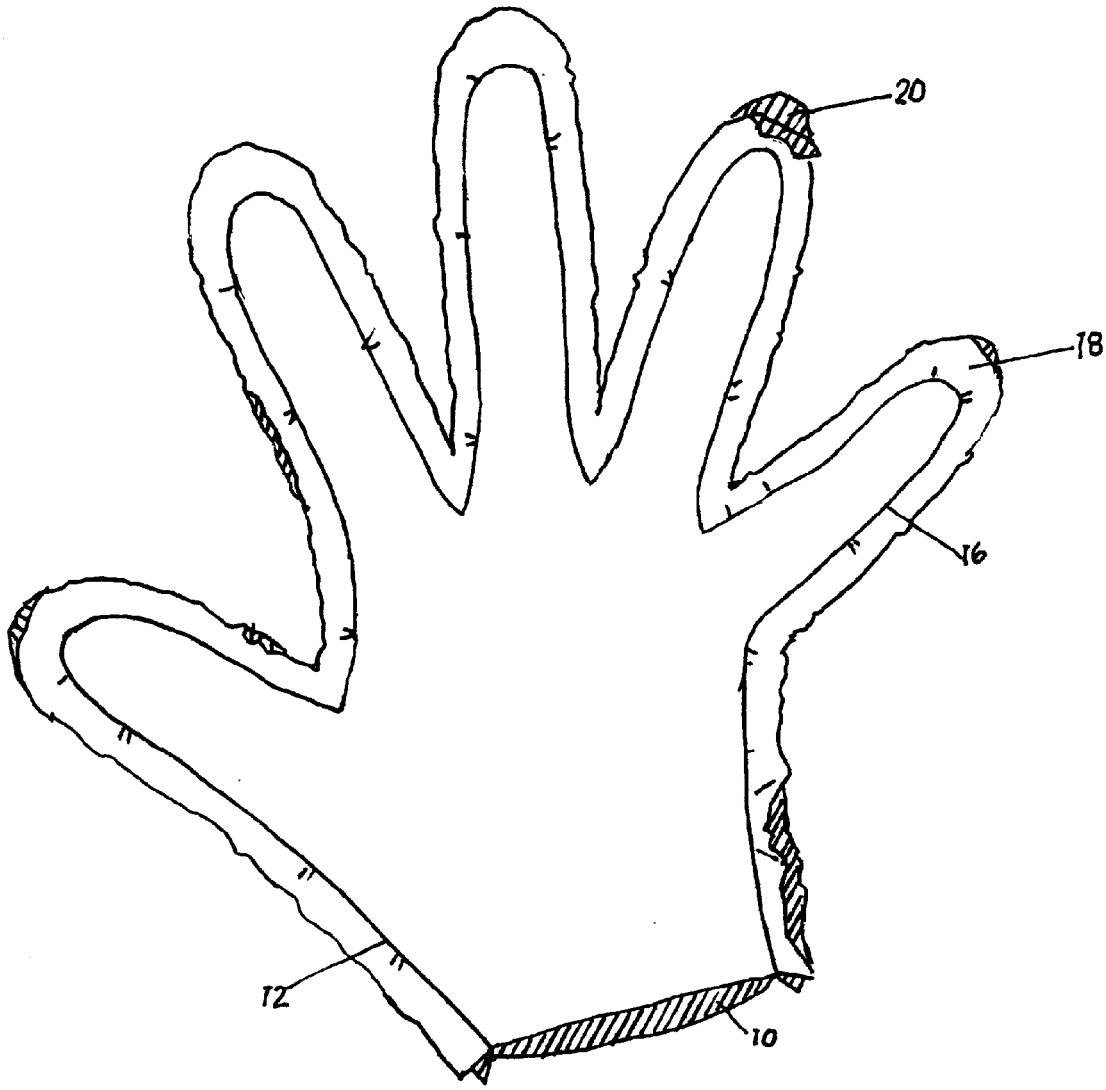
Figure 2B:
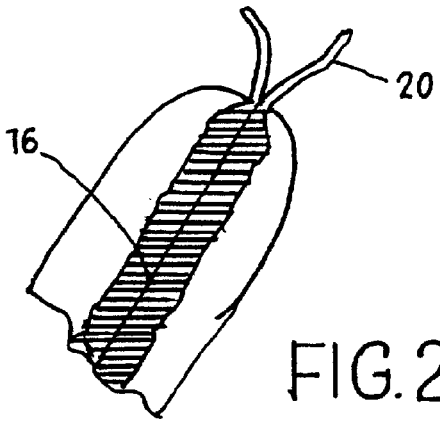

In FIG. 2A, an additional embodiment is shown with intentional, protrusive, exterior body side-seams 12 and finger side-seams 16 only; with the finger side-seams 16 terminating in an open, unstitched tuft 20 at each fingertip. FIG. 2B shows a side view of the tuft.

Figure 3A:
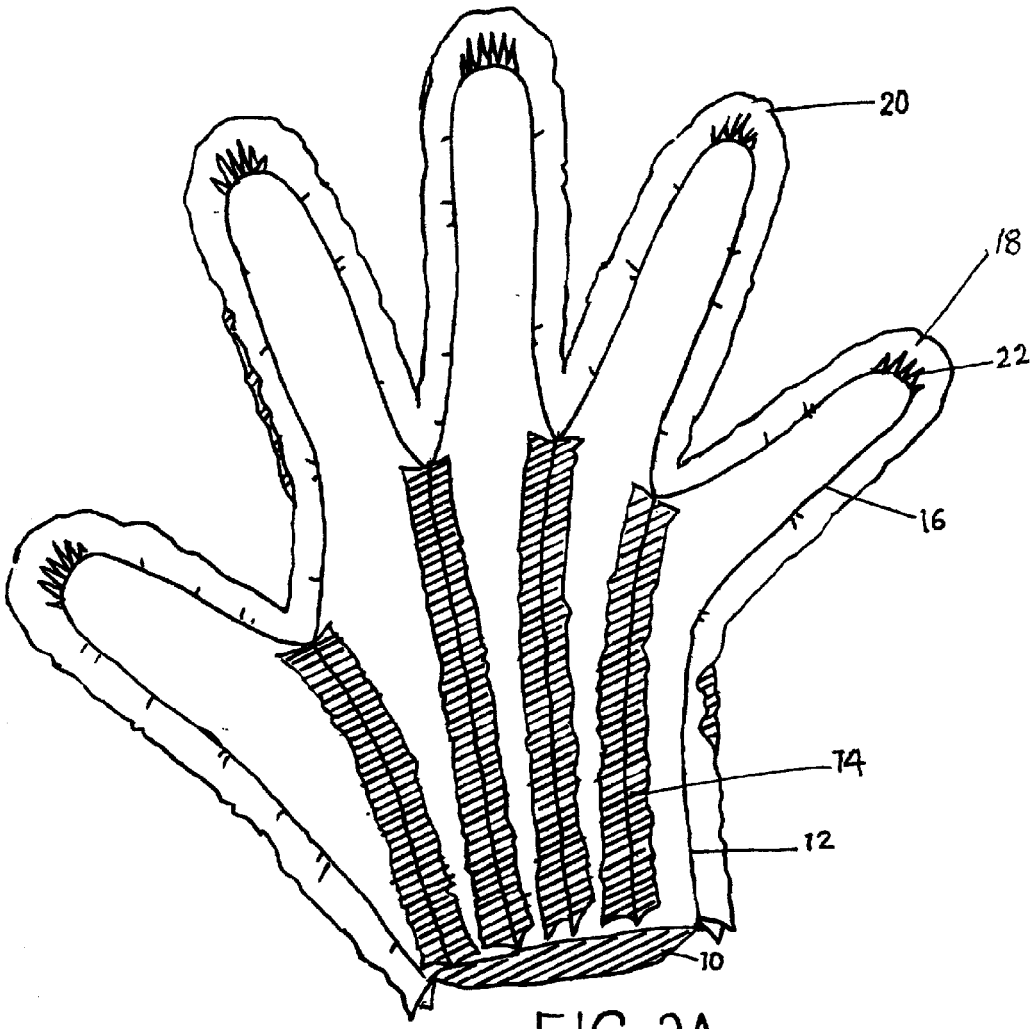
FIGS. 3A to 3C show a similar glove with a plurality of body side-seams, finger side-seams and palm seams with the finger seams terminating in a plurality of created tufts at each fingertip.
Figure 3B:
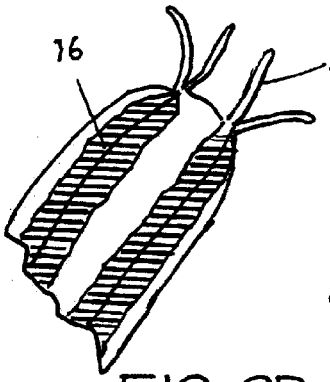
Figure 3C:
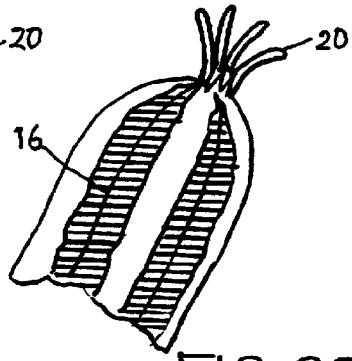
Figure 3D:
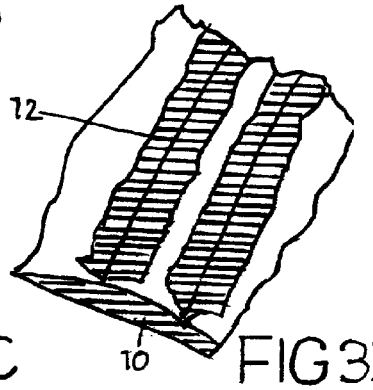

In FIG. 3A, another embodiment is shown with a plurality of intentional, protrusive, exterior body side-seams 12, a plurality of palm seams 14, and a plurality of finger side-seams 16 terminating in a plurality of created tufts 20 at each fingertip as seen in FIG. 3B. FIG. 3C shows a plurality of tufts joined to form one multiple tuft. FIG. 3D shows a plurality of body side-seams 12.

In the preferred embodiment, the base fabric is a micro fiber which excels for all purpose use; dusting, cleaning, washing, polishing or drying. However, the base fabric may consist of any other material as deemed suitable for a specific task. For example, a fleece fabric works very well for the application of cleaning solutions; a cotton fabric for absorption; a fibrous fabric for more aggressive tasks; a disposable paper product for convenience.

The fabric weight and content are a contributing factor in determining the number and placement of seams and tufts on my invention. For example, a fleece base fabric used for the application of cleaning solutions or a heavy cotton fabric used for polishing and drying will require fewer exterior seams because of the body mass of the fabric. And a simple self-tuft, without a decorative stitch, is often quite adequate. See FIG. 2A. The stretch factor in a base fabric, or base material, may also determine the number of exterior seams. A very firm base cloth (with no stretch) will benefit from a plurality of exterior seams which provide more give in order to enhance the fit and to improve ease of entry for the wearer's hand into the glove opening 10.

In addition to the mass of the base fabric, the number and positioning of exterior seams and tufts may also be determined by the cleaning tasks to be performed by my dusting-cleaning glove. For example, a plurality of specific exterior seams may be used as seen in FIG. 3A. Additional seams add bulk and more fabric mass is concentrated into a smaller dimension. And each exterior seam also creates a protrusive ridge which produces a frictional action when the glove is in use. An aggressive cleaning task will benefit from additional seams. Especially when combined with a fibrous fabric.

There are various possibilities with regard to the number and configurations of the tufts in my dusting-cleaning glove. As stated previously, the primary function of the tuft in my invention is to be an instant, built-in crevice device. However, the tuft(s) in my invention also functions as mini-wiping tools when used in small or cluttered cleaning areas. The efficiency of the tuft in my invention is dependent on the stiffness and body mass of the tuft itself. Again, the choice of a base fabric may dictate adaptations in the construction of the tuft(s). See FIG. 3B.

A critical construction feature of my invention is a snug, secure fit to the user's hand. The primary fit of my dusting-cleaning glove resides in the finger portions, thus eliminating the need for elastic or any fasteners at the glove's aperture 10. The snugness in the finger portions prevents the hand from slipping out of the glove when in use. The base fabric can be an important factor in the fit. When a non-stretch base fabric is used, additional exterior seams may be employed to enhance the fit. The effectiveness of the seam and tuft features of my invention is quite dependent upon a snug, secure fit in the finger portions. The fit contributes to an optimum awareness of points of contact with a cleaning subject. The trim fit of my dusting-crevice cleaning glove also assists the maneuverability of the fingers when dusting or cleaning. Therefore my dusting-cleaning glove will be manufactured in sizes X-small, small, med., large and X-large to assure the most effective performance for the user. When properly fitted, my invention functions as an integral part of the user's hand.

Operation—FIGS. 4, 5, 6, 7

Figure 4:
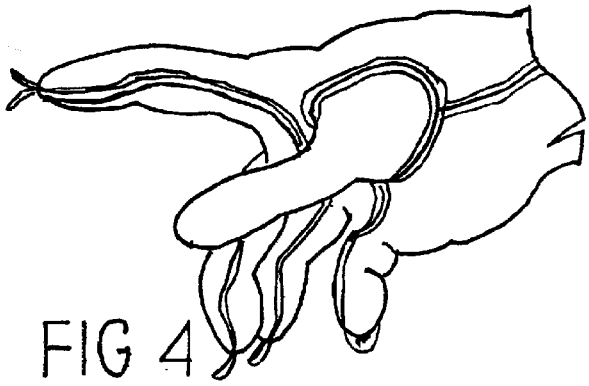
FIG. 4 shows how the tuft functions as a crevice tool.
Figure 5:
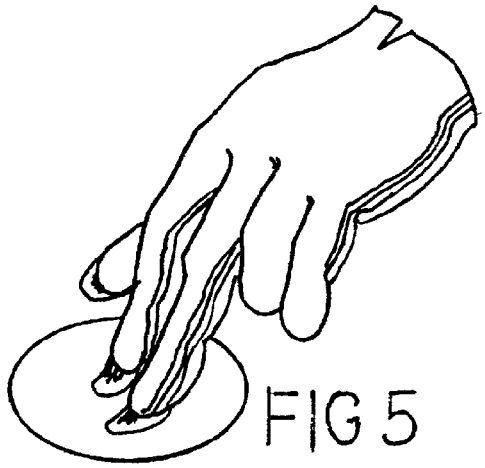
Figure 6:
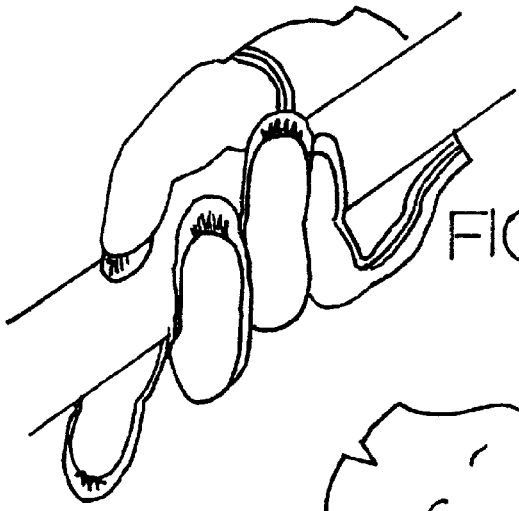
FIG. 6 shows how the tuft(s) functions in a confined area, exhibiting a wiping motion.
Figure 7:
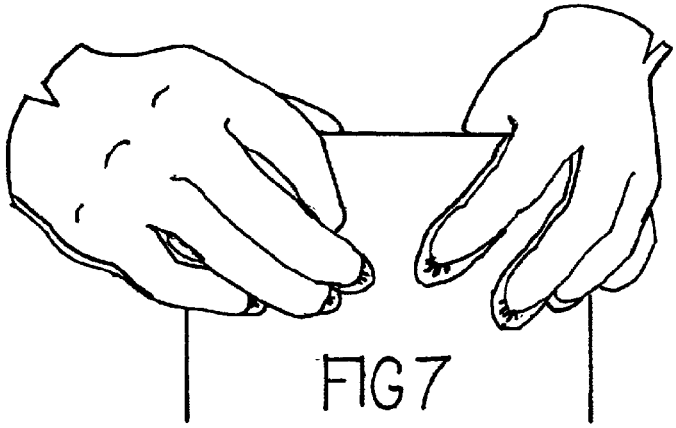
FIG. 7 shows how the trim fit and flexibility of the glove aids in grasping objects or other tools.

The manner of using my fitted dusting-cleaning glove is somewhat similar to that for other gloves, mitts and cleaning cloths in present use for ordinary cleaning tasks. But no other cleaning cloth, glove or mitt offers the instant, precision of operation-that my dusting-cleaning glove does. The tuft of my dusting-cleaning glove provides an automatic crevice device which extends finger reach as shown in FIG. 4. The tuft also functions as a precise wiping tool in close confines as demonstrated in FIG. 5. A plurality of exterior seams enhance the wiping capabilities and grasp of the entire hand as demonstrated in FIG. 6. The snug fit of the finger portions allows a full range of motion of the user's hands and allows the wearer of my dusting-cleaning glove to grasp objects and tools securely. Many cleaning tasks are conducive to the use of both hands. A glove on each hand can save time and motion. Small or hand-held objects can be grasped and cleaned simultaneously as demonstrated in FIG. 7.

Most professional cleaning people are quite adept at using both hands for nearly every possible cleaning task. While many others in practice prefer to use one hand at a time. Therefore, my dusting-cleaning glove will be offered singly as well as in pairs. The gloves are ambidexterous in construction, therefore, the user of a pair of gloves may switch hands in order to use the second side when the first side becomes soiled.

SUMMARY, RAMIFICATIONS AND SCOPE

The austerity of the design and the simplicity of the construction of my fitted dusting-cleaning glove with built-in crevice cleaning tuft provide exceptional flexibility and dexterity of motion to the act of dusting or cleaning. My invention is very versatile in function, from dusting to washing, to polishing and more. The tuft at each glove fingertip, functioning as a built-in crevice tool is designed to work in tandem with the user's fingers; functioning as a precise cleaning device in it's own right.

The trim, snug fit of the hand and finger portions of my dusting-cleaning glove with built-in crevice cleaning tuft allows the wearer the freedom of leaving the glove in place, on the hand(s) while switching to other cleaning tasks; or while using other tools.

As stated before, the number and positioning of exterior seams and crevice cleaning tufts as well as the base fabric, or base material, selected are all subject to modifications in order to accommodate the intended usage of my dusting-cleaning glove with built-in crevice cleaning tuft without departing from the scope and spirit of this invention. While my above description contains many specifications, these should not be construed as limitations on the scope of my invention, but rather as an exemplification of one preferred embodiment of the above. For example, although the edges (cut lines) of the intentional, exterior seams throughout the glove body, could be serged either before or after stitching, especially if the base fabric is prone to unraveling. In most cases, however, the raw edges of the open seams enhance the function of the glove. And the raw seam edges make the glove more economical to manufacture.

In practice, my seam and tuft concept could conceivably be applied to some already manufactured gloves. For instance, an unseamed knit glove could be converted into a cleaning glove by adding tucks or closed side-seams and closed finger side-seams which terminate in an expanded closed seam at the fingertip functioning as a crevice tool in a manner similar to my tuft concept. My seam and tuft concept could even be applied to already manufactured gloves made with interior seams by adding an exterior seam adjacent to the seamline on the outside of the glove. An exterior closed seam is created over the interior seam resulting in a rather bulky exterior ridge. While either glove would be useful in some cleaning situations. Both lack the trim fit of my preferred embodiment and the closed seam is not nearly as effective as an open, raw seam. The objective of exterior seams is to get the cleaning material into crevices and grooves; and my intentional exterior raw seams work superbly.

My seam and tuft concept could also be incorporated into a knit glove in the knitting process by simply creating ridges on the body-sides, palm and finger areas with a created nubby tuft at the fingertip. However, at this time my preferred embodiment is the fitted, intentional raw exterior seam application featuring a superior crevice device in the form of a tuft.

My tuft design is completely open to further development. Adaptations may include other shapes, additional length, stuffing or stiffening with a variety of substances or even the application of multiple tufts.

Accordingly, the scope of this invention should be determined not by the embodiment(s) illustrated, but by the appended claims and their legal equivalents.

I claim:

1. A snug fitted dusting-cleaning glove with an integral crevice cleaning tuft comprising at least two sheets of a base material that are joined by a plurality of exterior seams that are unfinished, raw, and open and form a seam line, the seams attaching the base material to provide a glove configuration including four independent finger portions, an independent thumb portion, and an opening for a user's hand, a seam allowance that is the distance between the seam line, an interior edge, and a cutting line, the cutting line being an outer edge of the base material, and the allowance having a width dimension between the seam line and cutting line, and wherein the seam allowance has a slightly expanded width at each tip of the finger and thumb portions thereby forming crevice cleaning tufts for cleaning.

2. The snug fitted dusting-cleaning glove of claim 1 wherein the glove is dimensioned to fit a user's hand in order to provide optimum freedom of movement, to provide finger sensitivity, and to provide independent manipulation of each individual tuft.

3. The snug fitted dusting-cleaning glove of claim 1 wherein the exterior seams have a texture and frictional properties.

4. The snug fitted dusting-cleaning glove of claim 3 wherein the exterior seams have means to prevent unraveling.

5. The snug fitted dusting-cleaning glove of claim 4 wherein the means to prevent unraveling is serging.

6. The snug fitted dusting-cleaning glove of claim 1 further comprising a decorative zigzag stitch on each of the tufts as a means for providing extra stiffness.

7. The snug fitted dusting-cleaning glove of claim 1 wherein the glove is constructed such that either side of the glove may be used.

* * * * *